US006180873B1

(12) United States Patent
Bitko

(10) Patent No.: US 6,180,873 B1
(45) **Date of Patent: *Jan. 30, 2001**

(54) CURRENT CONDUCTING DEVICES EMPLOYING MESOSCOPICALLY CONDUCTIVE LIQUIDS

(75) Inventor: Sheldon S. Bitko, East Brunswick, NJ (US)

(73) Assignee: Polaron Engineering Limited, Watford Herts. (DE)

( * ) Notice: Under 35 U.S.C. 154(b), the term of this patent shall be extended for 0 days.

This patent is subject to a terminal disclaimer.

(21) Appl. No.: 08/942,922

(22) Filed: Oct. 2, 1997

(51) Int. Cl.[7] ..... H01B 1/00

(52) U.S. Cl. ..... 174/9 F; 200/61.52; 200/182; 200/193; 200/233

(58) Field of Search ..... 174/9 F; 200/61.52, 200/193, 194, 233, 227, 228, 235, 182

(56) References Cited

U.S. PATENT DOCUMENTS 2,926,223 * 2/1960 Netterfield ..... 200/61.52
3,564,496 * 2/1971 Brooks et al. ..... 340/440
4,135,067 * 1/1979 Bitko ..... 200/61.52
4,207,100 * 6/1980 Kadokura ..... 430/48
4,278,854 * 7/1981 Krause ..... 200/52 A
5,900,602 * 5/1999 Bitko ..... 200/61.52

* cited by examiner

*Primary Examiner*—Kristine Kincaid
*Assistant Examiner*—W. David Walkenhorst
(74) *Attorney, Agent, or Firm*—Burns, Doane, Swecker & Mathis, LLP

(57) ABSTRACT

The present invention is directed to electrical devices incorporating mesoscopically conductive liquids. The devices of the present invention include switches constructed such that in one configuration a charge carrying element, such as an electrode, is insulated from a charge receiving element by a thick (super-mesoscopic) layer of a mesoscopically conductive liquid; and in another configuration, the charge carrying elements are proximate each other and the charge is conducted between the elements by a thin (sub-mesoscopic) layer of a mesoscopically conductive liquid. Preferred embodiments of the switches of the present invention are suitable substitutes for switches, relays, or other switching interfaces.

11 Claims, 5 Drawing Sheets

FIG. 7
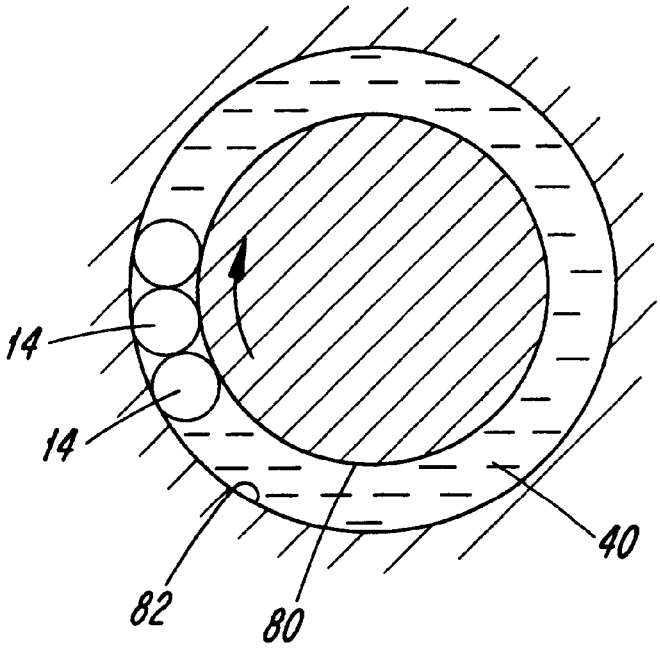
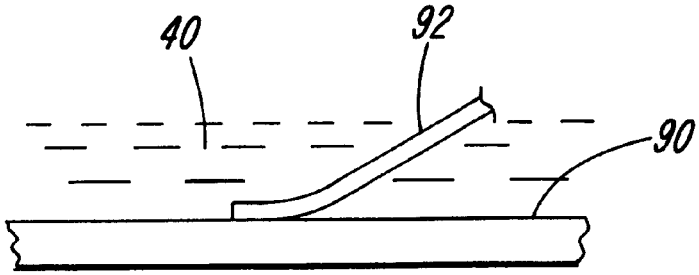
FIG. 8

CONTACT RESISTANCE VS. MESOSCOPIC LAYER THICKNESS AT CONSTANT TEMP., CURRENT, AND VOLTAGE (HYPOTHETICAL)

CURRENT CONDUCTING DEVICES EMPLOYING MESOSCOPICALLY CONDUCTIVE LIQUIDS

BACKGROUND OF THE INVENTION

The present invention relates to electric devices that facilitate, regulate, monitor, or otherwise modify current flowing through a current carrying system. Preferred embodiments of the present invention are electrical switches.

A principal feature of the present invention is the discovery that certain liquids have varying dielectric properties depending upon the thickness of the liquid layer. These liquids are referred to herein as mesoscopically conductive liquids or mesoscopic conductors or mesoscopic liquids. Thick layers of these mesoscopic liquids are insulators; whereas thin layers are conductors. One embodiment of the present invention involves a use of such mesoscopic conductors in a current carrying device wherein a conductor moves relative to a conducting surface, which it engages. Such embodiments are effective and dependable substitutes for various conventional switches such as mercury switches.

A mercury tilt switch is used for indicating the presence of an angular orientation through the creation of an electrical signal. Such uses range from thermostat controls and motion detectors, to ordinance devices and liquid level controls, among others. While liquid mercury provides an ideal medium in such a case, mercury possesses substantial drawbacks such as environmental pollution and toxicity. It is desirable to provide a non-mercury alternative to the mercury switch.

Workers attempting to satisfy that need have devised switches comprised of a chamber surrounding a mobile conductive element, e.g., gold plated balls, which fulfills the role of mercury. Strategically disposed within the chamber are electrodes. The gold plated ball functions as an alternative to the free flowing mercury. Thus, when the ball simultaneously contacts the electrodes, an electrical signal is transferred. Those devices, however, suffer from low current carrying or switching capacity, high contact resistance, short life and/or electrical bounce.

SUMMARY OF THE INVENTION

The present invention is directed to various devices exploiting mesoscopically conductive liquids. Mesoscopically conductive liquids are materials that operate as an insulator and as a conductor as a function of the thickness of a layer of the mesoscopic liquid. Such devices include current conducting devices such as switches, as well as other devices wherein the flow of current through the device is regulated or monitored. The invention further includes methods for regulating or monitoring current flow within a system.

In one embodiment, the mesoscopically conductive liquid is oriented within a charge carrying device as an interface between electrodes. In bulk, the mesoscopic liquid has high resistivity, acting as an insulator and thereby preventing or substantially eliminating charge transfer between electrodes. As the current carrying members approach each other, the thickness of the liquid mesoscopic conductor separating the electrodes diminishes, entering a mesoscopic range, wherein the liquid mesoscopic conductor relatively abruptly shifts from insulator to conductor, and charge or current is carried through the mesoscopic conductor between electrodes. In such an embodiment, the electrodes might be movable into and out of engagement or be permanently engageable. The relative movement of electrodes might involve rolling, rotating, sliding, or the like, or any combination thereof.

BRIEF DESCRIPTION OF THE DRAWINGS

The objects and advantages of an embodiment of the present invention is apparent from the following detailed description of preferred embodiments in connection with the accompanying drawings in which like numerals designate like elements, and in which:

FIG. 7 depicts an additional embodiment wherein the electrodes are in permanent, relatively rollable and/or slidable engagement;

FIG. 8 is a side view of still another embodiment of the invention where the electrodes are in permanent relatively slidable engagement;

DETAILED DESCRIPTION OF THE INVENTION

The present invention involves the use of liquid mesoscopic conductors in devices wherein current is conducted, and particularly wherein the current is to be modified, e.g., insulated, reduced, amplified, or otherwise regulated. For example, the invention includes the use of mesoscopic conductors in devices wherein a current carrying element is insulated under certain circumstances but permitted to conduct under other predetermined circumstances, e.g., a switch.

Mesoscopic conductors are a diverse group of chemicals that, in the liquid state, are characterized by a property not heretofore recognized in liquids. That property is characterized by a relatively abrupt variation in resistivity (and conductance) as a function of the open circuit voltage, current density, and thickness of a layer of such liquid. Other physicochemical characteristics are also expected to have an effect, such as the temperature and viscosity of the liquid. Mesoscopic conductors thus behave in a fashion analogous to that of the semiconductors, i.e., a high level of resistivity under certain circumstances that abruptly gives way to high levels of conductivity under other circumstances. Thus, for example, at constant voltage and current, a mesoscopic conductor will reversibly alternate between a dielectric and a conductor as a function of the thickness of a layer of the liquid.

A mesoscopic conductor can also be defined as a medium containing uncoordinated charge-carrying atoms, molecules, or functional groups that are conductive only at thicknesses or layer widths less than the mesoscopic inflection point, i.e., at sub-mesoscopic thicknesses; but are insulators in bulk or at thicknesses or layer widths greater than the mesoscopic inflection point.

Figure 11:
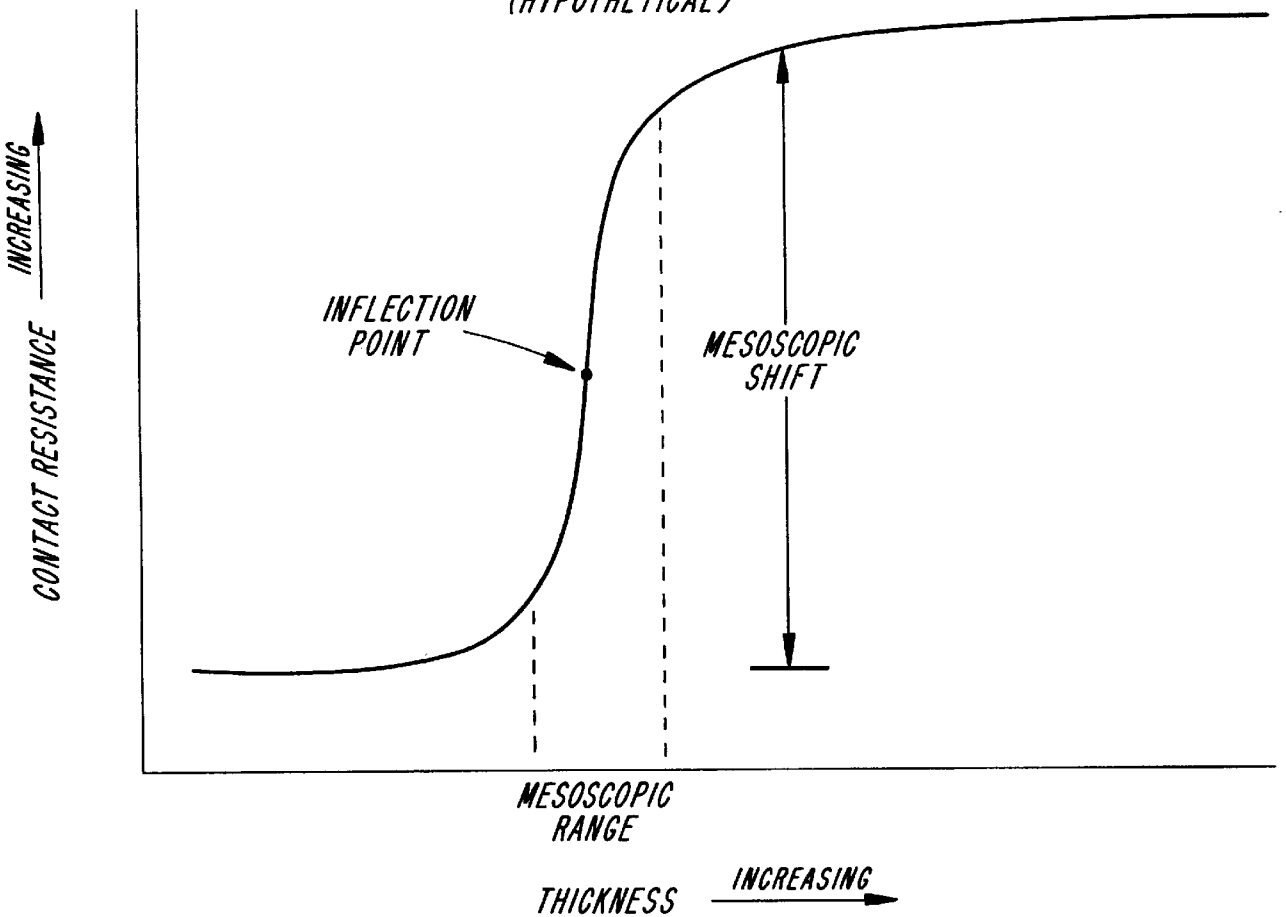
FIG. 11 is a plot of contact resistance as a function of layer thickness of a mesoscopically conductive liquid at constant voltage and current density.

At constant voltage and current, a mesoscopic conductor undergoes a pronounced change in conductivity as a function of the thickness of a layer of the mesoscopic conductor liquid separating charge carrying elements. If we were to plot resistance as a function of increasing layer thickness of a mesoscopic conductor, we would first see a relatively constant, low level of resistance over a narrow range of thicknesses. At thicknesses of about $10^{-4}$–$10^{-6}$ meters, a dramatic increase in resistivity is observed over a narrow thickness differential. The slope of the mesoscopic transition range is a function of the chemical and physical properties of the mesoscopic liquid. The differential in thickness over which this change is effected is referred to herein as the mesoscopic range. At thicknesses above the mesoscopic range, resistivity again becomes a nearly constant, but now high, value. Thus, the mesoscopic range is the change in thickness over which the mesoscopic shift (i.e., relatively large change in conductivity) is substantially complete. See FIG. 11. A mesoscopic conductor is thus a conductor at sub-mesoscopic thicknesses (i.e., thicknesses below the mesoscopic range); and a dielectric or an insulator at super-mesoscopic thicknesses (thicknesses above the mesoscopic range). When electrodes are separated by a layer of mesoscopic liquid of sub-mesoscopic thickness, they are said to be within mesoscopic proximity.

While the mesoscopically conductive properties of any mesoscopic conductor is likely to be unique to that particular material, mesoscopic conductors generally exhibit narrow mesoscopic ranges (as a function of thickness) over which dramatic changes in conductivity occur. The slope of the mesoscopic transition range is a function of the chemical and physical properties of the mesoscopic liquid. Mesoscopic conductors evidence fairly constant conductivity both above and below the mesoscopic range.

The mid-point of the mesoscopic range in a plot of resistance as a function of thickness is referred to herein as the inflection point. The mesoscopic range, and hence inflection point, are pronounced, identifiable, and reproducible at constant voltage and current. Thus, the inflection point of any mesoscopic conductor is readily determined by one of skill in the art using conventional instrumentation. That is, knowing what to look for, one of ordinary skill in the art can readily identify the mesoscopic phenomenon and measure the mesoscopic range, inflection point, and degree of mesoscopic shift.

This disclosure contemplates that there will always be at least a minimal continuous layer (i.e., at least one molecule thick) of mesoscopic conductor between electrodes. Thus, the sub-mesoscopic thickness will be that thickness ranging from the molecular diameter (or width or length) of the mesoscopic conductor material to the lower end of the mesoscopic range.

The present invention thus provides a new class of compounds, designated as mesoscopically conductive liquids, comprising polar chemical liquids, such as hydrocarbons and fluorocarbons, having a dipole moment such that the liquid is a dielectric at super-mesoscopic thicknesses (e.g., often greater than about 0.010 inch) and is electrically conductive under the effect of a polarizing electric field at sub-mesoscopic thicknesses (e.g., often less than about 0.001 inch). We have observed mesoscopic liquids with mesoscopic ranges at thicknesses between about 0.006 and about 0.004 inches. Dielectric is defined as a material having conductivity less than about 0.000001 mho/cm.

While not wishing to be bound by any theory, we suspect that the mechanism of charge transfer occurring in these materials is the same or analogous to those associated with other, e.g., solid state, systems. Thus, charge transfer might result from enhanced quantum tunneling, delocalized electron transfer, cluster effect, electron hopping, or other charge carrying mechanisms, operating either singularly or in concert, under the influence of the applied electrical field.

The mesoscopic conductors of the present invention are chemical liquids such as hydrocarbons and fluorocarbons that: are possessed of a polar functional group; are insulators in bulk; and are preferably hydrophobic or immiscible with water.

Preferred mesoscopic conductors are aliphatic hydrocarbons and substituted aliphatic hydrocarbons. The aliphatic hydrocarbons might be straight or branched chain hydrocarbons. Substituted aliphatic hydrocarbons include aliphatic hydrocarbons bearing additional cyclic hydrocarbons and/or aromatic hydrocarbons. Also preferred are halogenated hydrocarbons. Especially preferred are fluorohydrocarbons; and especially preferred are those wherein all of the hydrocarbon hydrogens (i.e., those attached directly to a carbon) are replaced with fluorine (also referred to herein as fluorocarbons).

Preferred mesoscopic conductors have a polar functional group, preferably at a terminal or external position in the molecule. For purposes of the present discussion, polar functional groups are groups having a dipole moment of at least about 1.5 Debye. Generally, more polar functional groups are preferred, i.e., those wherein the charge is readily displaced and/or those having a high charge differential. Preferred among such functional groups is the carboxylic acid or carboxylate functional group, as well as functional groups selected from the group consisting of alcohol, ester, ether, amine, amide, aldehyde, ketone, thiol, thiol ester, sulfonic acid, sulfonamide, sulfate, sulfite, phosphate, citrate, and the like.

A significant characteristic of mesoscopic conductors is that these liquids possess high resistivity in bulk. For purposes of the present disclosure, high bulk resistivity contemplates greater than about 1 megohm-cm (megohm-centimeter); preferably, greater than about 100 megohm-cms. Bulk resistivities of about one to two million megohm-cms are not uncommon and are well within the range of practical application within the present invention. High bulk resistivities are generally favored.

We have evaluated mesoscopic conductors that have a bulk electrical resistance in excess of $10^9$ ohms when the spacings between the electrodes are greater than about a few thousandths of an inch (i.e., within the super-mesoscopic range), and yet which have a resistivity of only 100 milliohms or less as a thin film (i.e., within the sub-mesoscopic range).

Since mesoscopic conductors must be insulators in bulk, they must avoid contamination with impurities that can act as electrolytes, especially if water is present. Preferred mesoscopic conductors are hydrophobic hydrocarbons or hydrocarbons that are not miscible with water. However, water miscible, or hydrophilic, or even hygroscopic liquids might also be used, provided such a liquid is isolated from ambient moisture as within a sealed vessel or compartment.

In all cases, the presence of water is reduced to a sufficiently low level to avoid (i) inhibiting the activity of the charge carriers when an electrical field is present, (ii) decreasing the bulk resistivity of the liquid; or (iii) effecting ionization as in an electrolyte.

Preferred mesoscopic conductors are those having a dielectric strength of at least about 50 volts/mil and preferably about 100 to about 4,000 volts/mil. Still more preferred are those having a dielectric strength greater than about 200 volts/mil.

Mesoscopic conductors are a diverse body of compounds. They may be found among surfactants, plasticizers, lubricants, and other organic compounds. Examples include dielectric containing organic charge donor semiconductors such as TTF (tetrathiafulvalene); dielectric containing organic charge acceptance semiconductors such as TCNQ (tetracyanoquinodimethane); silicones bearing polar functional groups; siloxanes bearing polar functional groups; fluorosilicones bearing polar functional groups; fluorosiloxanes bearing polar functional groups; and charge-carrying organometals.

Examples of preferred mesoscopic conductors are: carboxylated fluorinated ethers (including fluorinated polyethers such as perfluoropolyether, PFPE); perfluorophosphate ether; dibutoxy phthalate; trioctyl phosphate. Generally, among these materials, performance seems to improve with greater numbers of charge carrying groups.

Mesoscopic conductors can also be effectively combined or blended with non-mesoscopic, non-polar liquids. These additives or blending agents must comport with the requirements of mesoscopically conductive liquids generally, e.g., not an electrolyte, though they need not exhibit the unique mesoscopic properties of mesoscopically conductive liquids. Preferably, the additive will be miscible with the mesoscopically conductive liquid. Such blends are advantageous for, e.g., the economic advantage conferred.

It is further contemplated that mesoscopically conductive liquids, per se, can be blended. Such blends of mesoscopically conductive liquids might be prepared to achieve a specific constellation of mesoscopic properties, e.g., effecting a mesoscopic shift within a predetermined mesoscopic range, i.e., slope modification, or at predetermined voltage or current density. Thus, the foregoing materials can be used either neat or blended in a suitable carrier solution otherwise fulfilling the criteria identified herein.

The unique and advantageous properties of mesoscopic conductor liquids ensure that such liquids will prove to be useful in a wide variety of applications. For example, mesoscopic conductors will be useful in the fabrication of various types of switches, varistors, liquid state transistors, magnetically operated relays, liquid state transistors, visual display devices, electronically adjustable capacitors, thermocouples, thermostats, pressure sensors, accelerometers, adjustable capacitors (i.e., electronically adjustable), and other such devices that will readily suggest themselves to the skilled worker in this art in view of the present disclosure.

The present invention provides, among other things, a current carrying device comprising a pair of electrodes and a mobile or variably positioned conductive or charge carrying element (or shorting element or member) surrounded by, or separated from an electrode by, a layer of mesoscopic liquid. In one embodiment, the mobile shorting element is perpetually in electrically conductive proximity (or mesoscopic proximity) to at least one electrode. As such, the mobile shorting element functions as a variably positioned extension of at least one electrode. Alternatively, the current carrying device comprises a pair of electrodes and a mesoscopically conductive liquid, said electrodes separated by a layer of mesoscopically conductive liquid and a suitable shorting element.

In one embodiment the electrodes and mobile charge carrying element are configured so that at least one electrode and the mobile charge carrying element are substantially in perpetual mesoscopic proximity; under specified conditions, the mobile charge carrying element moves into mesoscopic proximity, and thus electrically connects, the remaining electrode. The action of the mobile charge carrying element is such that the electrodes are functionally isolated from each other only by the orientation of the mobile charge carrying element and the variable thickness of the mesoscopic conductive liquid. When the distance between the mobile charge carrying element and the remaining electrode is great, i.e., a super-mesoscopic distance, there is no electrical connection; when the distance is small, i.e., a sub-mesoscopic distance or within mesoscopic proximity, an electrical connection is effected.

The present invention provides a method for regulating or controlling current flow through a current carrying device comprising separating electrodes by a layer of mesoscopically conductive liquid of variable thickness, and regulating the current flow between said electrodes by varying the thickness of said mesoscopic conductor liquid separating said electrodes. In such a method, the current flow is either facilitated or prevented as a function of the thickness of a layer of a mesoscopic conductive liquid separating the electrodes. Because of the abrupt and profound mesoscopic shift, the mesoscopic conductor is, in a first configuration, an insulator; yet, in a second altered configuration, it is a conductor.

Such a device will be recognized by one of ordinary skill in the art as a useful substitute for a switch, particularly a mercury switch. These materials and configurations also offer a means for detecting or measuring subtle variations in orientation or thickness of a material.

Figure 1:
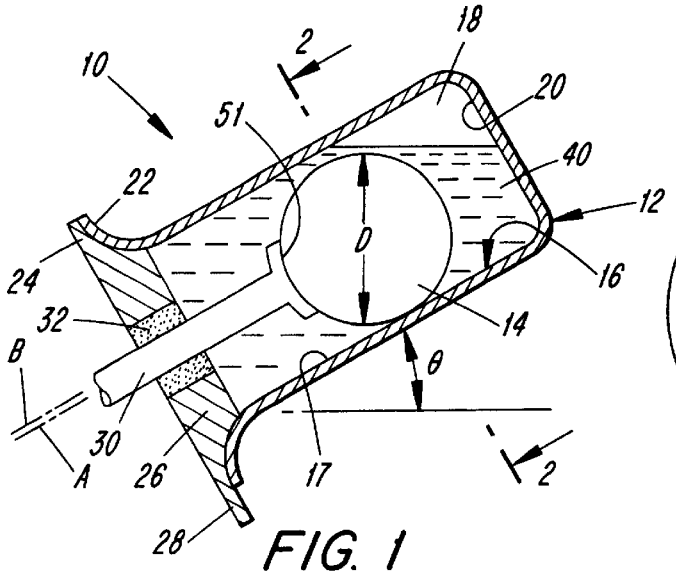
FIG. 1 is a longitudinal sectional view of a first embodiment of the invention with the longitudinal axis oriented at an angle to the horizontal, utilizing a spherical ball as a shorting element.
Figure 2:
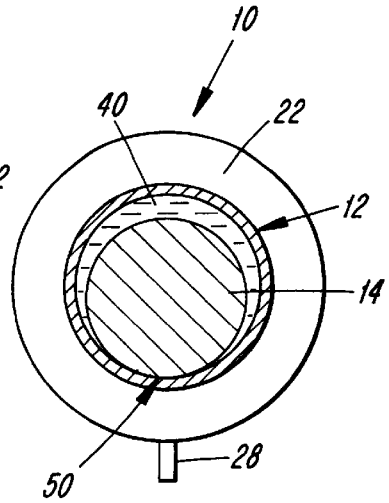
FIG. 2 is an end view of FIG. 1, showing the proximity of the ball to the case.

More particularly, an embodiment of a tilt switch 10 is depicted in FIGS. 1 and 2. This embodiment comprises a case 12 and a ball-shaped, i.e., spherical, shorting member 14 displaceably mounted within a chamber 18 formed by the casing. The inner surface 16 of the casing, which includes a cylindrical portion 17 and a circular portion 20, is symmetrically configured about a longitudinal axis B of the chamber, and is formed of an electrically conductive material such as a metal. The diameter of the cylindrical portion is larger than the diameter D of the shorting member 14.

At an end of the casing opposite the circular surface portion 20, an electrically conductive terminal 30 is sealed by an insulator 32 within a conductive shell 26, which shell has an extended flange 24 welded to an extended flange 22 of the case 12. The conductive shell has a tab 28 which provides for electrical termination of the case. An end of the terminal 30 projects into the chamber 18 and includes a terminal face 51 desirably, but not necessarily, shaped as a spherical segment of the same diameter as the sphere 14, i.e., diameter D. Other surface shapes could be used as well.

The terminal 30 extends along an axis A, which axis A is offset relative to axis B so that when the shorting member 14 rolls into contact with terminal 30, the axis A will pass through the geometrical center of the shorting member 14 for alignment of that member in the terminal face 51. The mutually contacting faces of the terminal 30 and sphere 14 define an electrically conductive interface 52 (see FIG. 4*a*) which is desirably, but not necessarily, shaped to maximize the contact area between the terminal 30 and shorting member 14. In similar manner, the diameter of shorting member 14 is preferably selected to maximize the contact area with the inner surface 17 of the casing at an interface 50 established therebetween (see FIG. 4*b*). The contacting faces can be formed of any suitably conductive material such as ferrous material (preferably copper), gold, etc.

The switch casing is filled with a suitable volume of a mesoscopic liquid 40. The mesoscopic liquid 40 is selected to suit the conditions under which the switch will be used. Such factors as temperature exposure, viscosity, dielectric strength, and other parameters commonly considered in the fabrication of a typical electrical switch will be considered. Thus, for example, mesoscopic liquids will typically be chosen having viscosities in the range of about 2 to about 25,000 centistokes although useful devices having liquids of a viscosity up to its pour point at room temperature are also useful. Viscosities of about 2 to about 100,000 centistokes are preferred.

Insofar as embodiments of the present invention are contemplated as substitutes for mercury tilt switches, mesoscopic conductor liquids might be chosen such that they are in a liquid state within the same or similar temperature range as mercury. Thus, mesoscopic conductors having a suitable viscosity with the range of about −40° C. to about 150° C. will find common application in the present invention. However, widely divergent conditions of use, with or without modifications to the structure of the containment compartment for the mesoscopic conductor within such a switch, will enable utilization of a vast array of mesoscopic conductors having substantially divergent properties.

Similarly, contact resistance of the mesoscopic conductor liquid will be factored into the selection. The contact resistance in a device using commonly utilized mesoscopic conductor liquids will be less than about 10 ohms; preferably less than about 150 milliohms; and still more preferably less than about 50 milliohms.

Figure 4A:
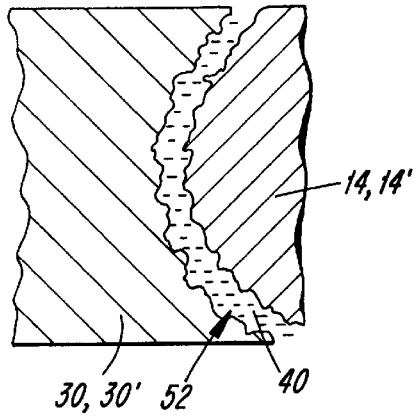
FIGS. 4*a* and 4*b* are fragmentary views depicting an interface between the roller and the case and an interface between the roller and the insulated electrode.
Figure 4B:
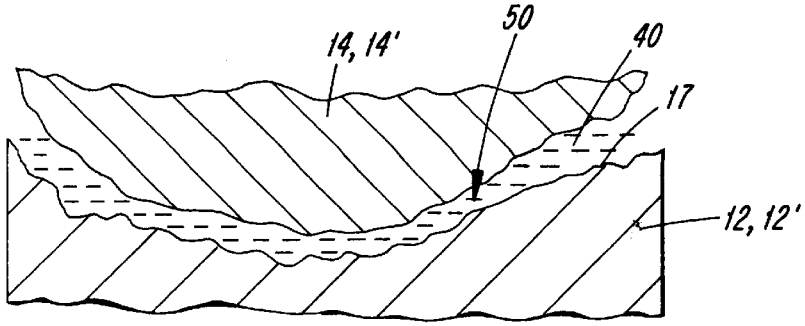

Generally, the inner surface 16 of the casing, the shorting element 14 and the face 51 are all wetted by the mesoscopic conductor liquid. It will be appreciated that the inner surface 16, the shorting element 14 and the face 51 are not perfectly smooth, and as shown in FIGS. 4*a* and 4*b*, produce between one another, spacings of various gaps as a function of the force exerted by the shorting element toward the face 51. That force is, in turn, a function of: gravity, the viscosity of the mesoscopic conductor, the surface tension of the mesoscopic conductor liquid and the roughness of the opposing materials. It is desirable for the geometry of those components to maximize the contact area which will provide the maximum number of sites where the interfacial gap is minimized. To enhance the number of such sites, it is also desirable to highly polish or smoothly finish the surfaces which define the interfaces 50, 52, thereby minimizing the number of large projections which, by virtue of their presence, tend to separate the surfaces in a manner creating large gaps instead of the desired small gaps.

The mesoscopic liquid 40 must possess a relatively high electrical resistivity when in bulk (so as to avoid conducting current directly between the terminal 30 and the casing 12), and yet possess a relatively low electrical resistivity when in the form of a thin film (i.e., when disposed in the interfaces 50, 52) so as to be highly electrically conductive.

Figure 3:
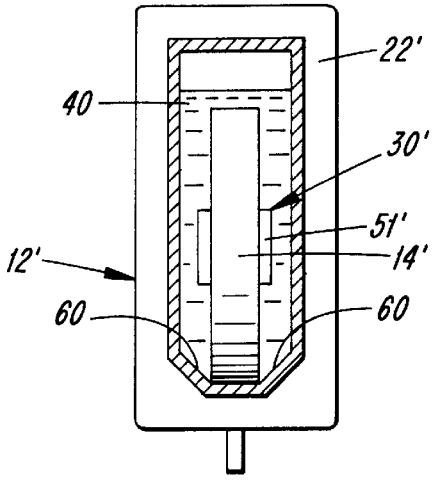
FIG. 3 depicts another embodiment similar to FIG. 1 but using a cylinder as the shorting element.

FIG. 3 depicts a device similar to FIG. 1 except that the spherical shorting element has been replaced by a cylindrical shorting element 14' of circular cross section, and shoulders 60 have been provided on a floor of the casing 12' to keep the cylinder properly centered. Also, the face 51' of the insulated terminal 30' has been shaped as a segment of a cylinder to conform to the outer periphery of the cylinder 14'.

In operation, it is obvious that if the left end of the insulated terminal 30 or 30' is tilted so that it is above the right-hand end, the shorting element 14 or 14' will roll away from the face 51 or 51', thereby providing an open circuit. The bulk resistance of the mesoscopic conductor 40 is so large that no shorting can occur between the terminals 30 and 12, or 30' and 12'. Tilting the left end of the terminal 30 to a level below the right-hand end will cause the shorting element 14 or 14' to contact the casing and the face 51 or 51' simultaneously, thereby closing the circuit. Connection to the switch is made via the external terminal portion of terminal 30, and to the casing via a shell tab 28. The mesoscopic conductor reaches a submesoscopic thickness at the interfaces 50, 52, thereby reducing the electrical resistance to a substantially lower level than would have occurred in the absence of such liquid. Electrical load tests carried out in similar devices have indicated the presence of a contact resistance of less than 100 milliohms in some tests at current levels over 1 ampere. These results are in some respects equal to those found in prior art mercury switches of approximately the same size or a little smaller.

Figure 5A:
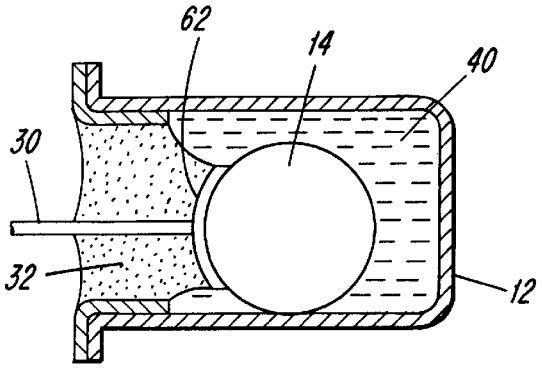
FIGS. 5*a* and 5*b* depict yet another embodiment of the invention.
Figure 5B:
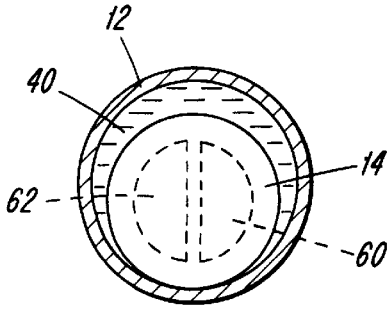

In another embodiment, shown in FIGS. 5*a* and 5*b*, the electrodes are in the form of a pair of semi-circular segments 60, 62 extending through the insulator 32. The segments are horizontally spaced and include surfaces shaped complementarily to that of the shorting member 14, i.e., either spherical or cylindrical. The shorting member contacts both electrodes simultaneously during tilting of the casing to close the circuit.

Figure 6A:
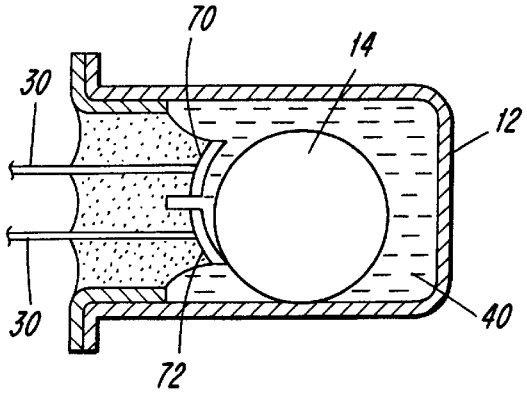
FIGS. 6*a*–6*c* depict another embodiment wherein the electrodes are in permanent, relatively rollable engagement.
Figure 6B:
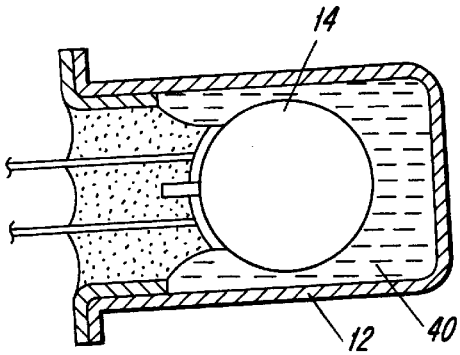
Figure 6C:
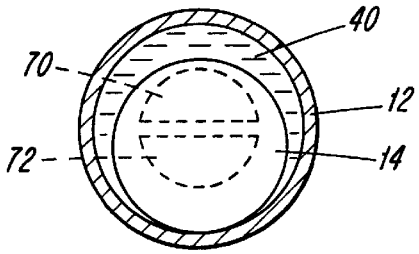

In another embodiment, shown in FIGS. 6*a*–6*c*, the semi-circular electrode segments 70, 72 are vertically spaced apart. Thus, the shorting member 14 initially makes contact only with the lower electrode 72 during tilting of the case (see FIG. 6*a*). Thereafter, in response to further tilting of the casing, the shorting element 14 also contacts the upper electrode 70 to close the circuit (see FIG. 6*b*). In that way, control is maintained over the extent to which the casing must tilt in order to cause the circuit to be closed.

In still another embodiment of the invention, shown in FIG. 7, shorting elements 14 are disposed between two relatively rotatable cylindrical surfaces 80, 82. The surfaces 80, 82 constitute electrodes, and the shorting elements 14 roll and slide while conducting current between those electrodes.

In yet another embodiment of the invention, shown in FIG. 8, the electrodes comprise a surface 90, and a moveable member 92 variably positioned across the surface 90.

Figure 9A:
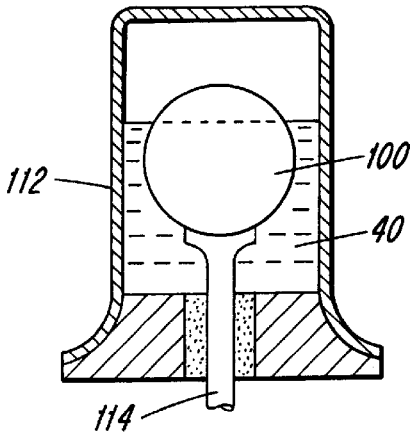
FIG. 9*a* is a cross-sectional view of another embodiment of the present invention wherein a tilt switch is in a normally open state.
Figure 9B:
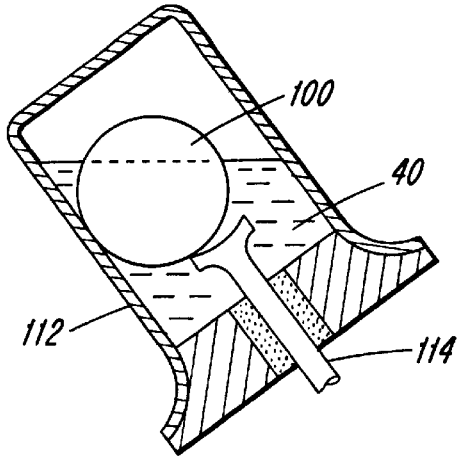
FIG. 9*b* is a view of the switch according to FIG. 9*a* after being tilted to a closed state.

Depicted in FIGS. 9*a*, 9*b* is a preferred embodiment of an omni-directional tilt switch which is normally open and is closed by being tilted in any direction by a predetermined angle. As a result of such tilting, an electrically conductive ball 100 is displaced from a position seated on a spherical surface of a terminal 114 (FIG. 9*a*) to a position engaging both the terminal 114 and a wall of a conductive casing 112 (FIG. 9*b*). The casing is flooded with mesoscopic liquid 40.

Figure 10A:
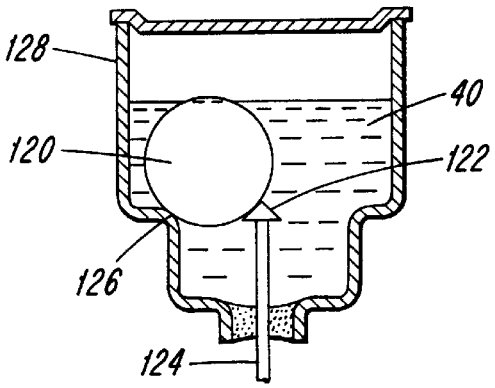
FIG. 10*a* is a cross-sectional view of another embodiment of the invention wherein a tilt switch is in a normally closed state.
Figure 10B:
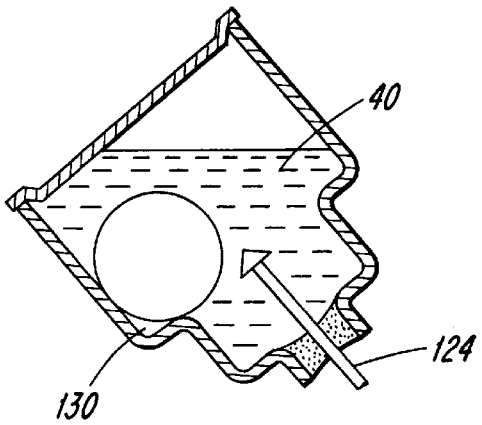
FIG. 10*b* is a view of the switch according to FIG. 10*a* after being titled to an open state.

In FIGS. 10*a*, 10*b* there is shown an embodiment of a tilt switch which is normally closed. That is, an electrically conductive ball 120 normally engages a head 122 of a terminal 124 (FIG. 10*a*) and an edge 126 of a casing 128. When the casing is tilted beyond a predetermined angle (FIG. 10*b*) the ball 120 rolls into a recess 130 of the casing and out of contact with the terminal 124 to open the circuit. The surface of the head 122 can be of any suitable shape, such as spherical to conform to the shape of the ball 120.

In all of the above embodiments of FIGS. 5*a* through 8, the mesoscopic liquid 40 functions to significantly reduce the electrical resistivity at the terminal interfaces in the manner explained earlier herein.

The present invention further provides a method for regulating current flow through a current carrying device comprising separating electrodes by a layer of mesoscopically conductive liquid of variable thickness, and regulating the current flow between said electrodes by varying the thickness of said mesoscopically conductive liquid separating said electrodes. The thickness of the liquid layer separating said electrodes includes the variations effected by movement or other variations in a shorting element.

Although the invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. In combination, a plurality of electrically conductive members movable relative to one another and configured to form an electrically conductive interface therebetween, the electrically conductive members positioned in a housing which also contains a mesoscopically conductive liquid that reduces the electrical resistivity at the interface without creating a short when the electrically conductive members are out of mutual engagement.

2. A current carrying device comprising a pair of electrodes and a variably positioned shorting member surrounded by a mesoscopically conductive liquid, said shorting member in perpetual mesoscopic proximity to one electrode and wherein said electrodes are variably electrically connected as a function of the position of the shorting member relative to the two electrodes.

3. A switch having a plurality of electrodes movable relative to one another and a variably positioned shorting member surrounded by a mesoscopically conductive liquid layer, and structured such that there is at least one configuration in which the layer of mesoscopically conductive liquid insulates one electrode from the other and from the variably positioned shorting member; and another configuration in which the layer of mesoscopically conductive liquid and the variably positioned shorting member conducts current from one electrode to the other.

4. The device of claim 3, wherein the mesoscopically conductive layer acts as an insulator at thicknesses of at least 100 $\mu$m; and as a conductor at thicknesses of less than 50 $\mu$m.

5. The device of claim 3, wherein the mesoscopic liquid is a hydrocarbon or fluorocarbon having at least one polar functional groups.

6. The device of claim 5, wherein the at least one polar functional group is selected from the group consisting of: carboxylic acid, alcohol, ester, ether, amine, amide, aldehyde, ketone, thiol, thiol ester, sulfonic acid, sulfonamide, sulfate, sulfite, phosphate, citrate, and combinations thereof.

7. The device of claim 5, wherein the at least one polar functional group is carboxylic acid.

8. The device of claim 5, wherein the mesoscopic liquid is selected from the group consisting of aliphatic carboxylic acids, aliphatic alcohols and glycols, aliphatic ethers, alkylated phosphates, and fluorinated derivatives thereof.

9. A method for regulating current flow through a current carrying device comprising separating electrically conductive members by a layer of mesoscopically conductive liquid of variable thickness, and regulating the current flow between said electrically conductive members by varying the thickness of said mesoscopically conductive liquid separating said electrically conductive members.

10. The method of claim 9, wherein the mesoscopically conductive liquid is a hydrocarbon or fluorocarbon having at least one polar functional group.

11. The method of claim 9, wherein the at least one polar functional group is selected from the group consisting of: carboxylic acid, alcohol, ester, ether, amine, amide, aldehyde, ketone, thiol, thiol ester, sulfonic acid, sulfonamide, sulfate, sulfite, phosphate, citrate, and combinations thereof.

* * * * *